United States Patent [19]

Turner

[11] Patent Number: 4,967,929

[45] **Date of Patent: * Nov. 6, 1990**

[54] LABEL DISPENSER AND HOLDER

[75] Inventor: Paul F. Turner, Earlham, Iowa

[73] Assignee: Net Associates, Inc., Des Moines, Iowa

[ * ] Notice: The portion of the term of this patent subsequent to Apr. 18, 2006 has been disclaimed.

[21] Appl. No.: 337,575

[22] Filed: Apr. 13, 1989

Related U.S. Application Data

[63] Continuation-in-part of Ser. No. 45,531, May 4, 1987, Pat. No. 4,821,918.

[51] Int. Cl.[5] ..... B65H 5/28

[52] U.S. Cl. ..... 221/70; 221/73; 221/92; 221/283; 156/584; 248/214; 242/55.3; 312/39

[58] Field of Search ..... 221/70–73, 221/74, 92, 197, 282, 283, 285, 286, 311; 222/175, 180; 156/584; 211/175; 248/214, 309.1; 206/389, 390, 391, 409, 411; 242/55.2, 55.3, 55.53, 76; 312/39

[56] References Cited

U.S. PATENT DOCUMENTS

| | | | |
|---|---|---|---|
| 1,487,607 | 3/1924 | Rosen . | |
| 2,372,245 | 2/1945 | Avery . | |
| 2,373,092 | 4/1945 | Avery | 206/58 |
| 2,616,599 | 11/1952 | Hryhorczuk | 224/42.07 |
| 2,838,171 | 6/1958 | Kaspar | 206/58 |
| 2,912,140 | 11/1959 | Cole | 221/70 |
| 3,231,130 | 1/1966 | Foote | 221/70 |
| 3,388,830 | 6/1968 | Short | 221/73 |
| 3,547,327 | 12/1970 | Mariani | 225/38 |
| 3,554,847 | 1/1971 | Broemmlsiek | 156/584 |
| 3,698,600 | 10/1972 | Foote | 221/70 |
| 3,793,123 | 2/1974 | Aronson | 156/584 |
| 4,252,258 | 2/1981 | Plummer, III | 225/25 |
| 4,623,073 | 11/1986 | Hansen | 221/283 X |
| 4,821,918 | 4/1989 | Turner | 221/73 X |

FOREIGN PATENT DOCUMENTS 1349490 12/1962 France .

*Primary Examiner*—David H. Bollinger
*Attorney, Agent, or Firm*—Zarley McKee, Thomte, Voorhees & Sease

[57] ABSTRACT

The label dispenser and holder of the present invention includes a rectangular frame having a bottom support member, a top member, a pair of spaced apart end members, a back member, and a front member. At least two rectangular label dispensers are positioned within the holder. The holder includes various brackets which permit it to be universally mounted to various types of supporting surfaces, including a bracket for detachably securing the holder to a person's belt. The dispenser box of the present invention includes a pair of spaced apart slits in the edge wall of the box. Either one or two guide members are provided within the box for guiding a label type having a backing strip and a label strip detachably adhered to one side of the backing strip. The guide members guide the label tape so that the labels are separated from the backing strip and are expelled from one of the two slots in the edge wall of the box.

14 Claims, 5 Drawing Sheets

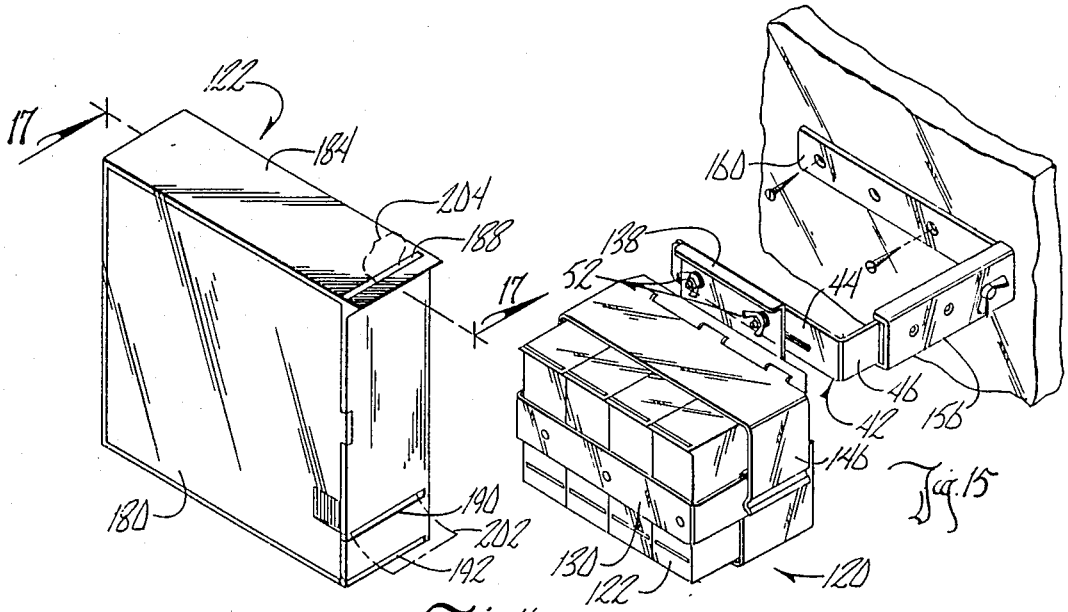
Fig. 15
Fig. 16
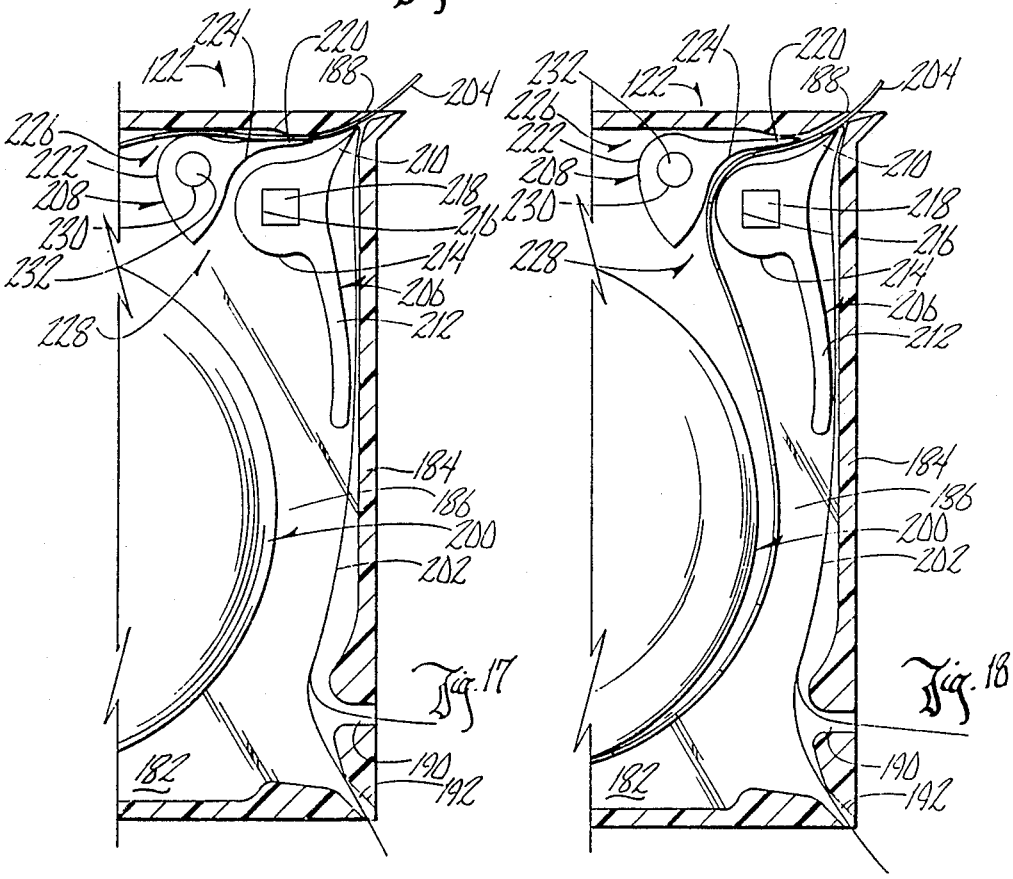
Fig. 17
Fig. 18

LABEL DISPENSER AND HOLDER

This is a continuation-in-part of co-pending application Ser. No. 045,531, filed May 4, 1987, now U.S. Pat. No. 4,821,918 dated April 18, 1989.

BACKGROUND OF THE INVENTION

The present invention relates to a label dispenser and holder.

The U.S. Postal Office requires bulk mailings to be sorted and to contain separate labels for identifying various types of bundled mail. The postal service supplies to mailers rectangular paperboard boxes containing these labels, and these boxes are used to dispense the various labels during the mailing process.

The boxes supplied by the U.S. Postal Service are difficult to handle, and are particularly difficult to handle when dealing with large volumes of mail as is the case in providing custom printing and mailing services.

Therefore, a primary object of the present invention is the provision of an improved label dispenser and holder.

A further object of the present invention is the provision of a holder for label dispensers which includes brackets for universally attaching the holder to various types of surfaces and tables.

A further object of the present invention is the provision of a holder for label dispensers which can be attached to a person s belt so that the person can remove the labels while standing or moving.

A further object of the present invention is the provision of an improved dispenser box which is easier to use and more durable than the dispenser boxes presently supplied by the U.S. Postal Service.

A further object of the present invention is the provision of an improved dispenser box which can accommodate a coil of labels having a backing strip and a label strip wherein the label strip is on either the interior or the exterior surface of the backing strip.

A further object of the present invention is the provision of a label dispenser and holder which is economical to manufacture, durable in use and efficient in operation.

SUMMARY OF THE INVENTION

The present invention contemplates a holder for a plurality of label dispensers. The holder includes a rectangular frame having a bottom support member, a top support member, a pair of spaced apart end members, a back member, and a front member. The label dispensers are positioned in side-by-side relationship within the rectangular frame, resting on the bottom member. At least one of the members of the rectangular frame, preferably the front member, is movable to a position which permits the insertion and removal of the rectangular dispensing boxes from the holding frame.

The holding frame of the present invention includes two L-shaped brackets which are movably attached to the holding frame, and which are capable of universal attachment to various types of table edges, table tops, partitions or sorting trays. One of the L-shaped brackets includes a sleeve capable of receiving and retentively holding one leg of the other L-shaped bracket. In addition, a belt bracket is also attached to the holding frame and is capable of being detachably secured to a wearer's belt so that the holding frame can be worn on a user's belt. Rubber bands can be attached to the belt bracket for further securement of the belt bracket to the wearer's belt.

The present invention also contemplates utilizing an improved dispenser box for dispensing the labels. The dispenser box is rectangular in shape and includes at least a pair of elongated slots in its edges. A guide member is positioned within the box adjacent one of the slots and includes leaf portions extending opposite directions from the slot. A label tape is coiled within the box and includes a backing strip and a continuous label strip which is detachably adhered to the backing strip. The label tape is threaded between one of the leaf portions of the guide member and the edge wall of the dispenser box. At the slot in the dispenser box, the continuous label strip is separated from the backing strip and extends through the slot to the exterior of the box. The backing strip continues within the box between the other of the leaf portions of the guide member, and ultimately exits the box at the second slot in the guide wall. By pulling the backing strip which extends out of the rectangular box, it is possible to feed the label strip outwardly through the first mentioned slot in the box.

A modified form of the dispenser box includes two separate guide members forming two separate paths for the label tape. One path is for a label tape having the label strip on the exterior surface of the coiled backing strip. The other guide path is for a label tape having the label strip on the interior surface of the coiled backing strip. Also, a bearing assembly is provided for centering the coiled tape and for facilitating rotation of the coil within the dispenser box.

BRIEF DESCRIPTION OF THE DRAWINGS

FIG. 15 is a perspective view showing an alternate manner of mounting the device of FIG. 10.

FIG. 16 is a perspective view of a modified form of dispenser box.

FIG. 17 is a sectional view taken along line 17—17 of FIG. 16.

FIG. 18 is a partial view similar to FIG. 17, but illustrating an alternate path for the label tape.

DETAILED DESCRIPTION OF THE PREFERRED EMBODIMENT

Figure 1:
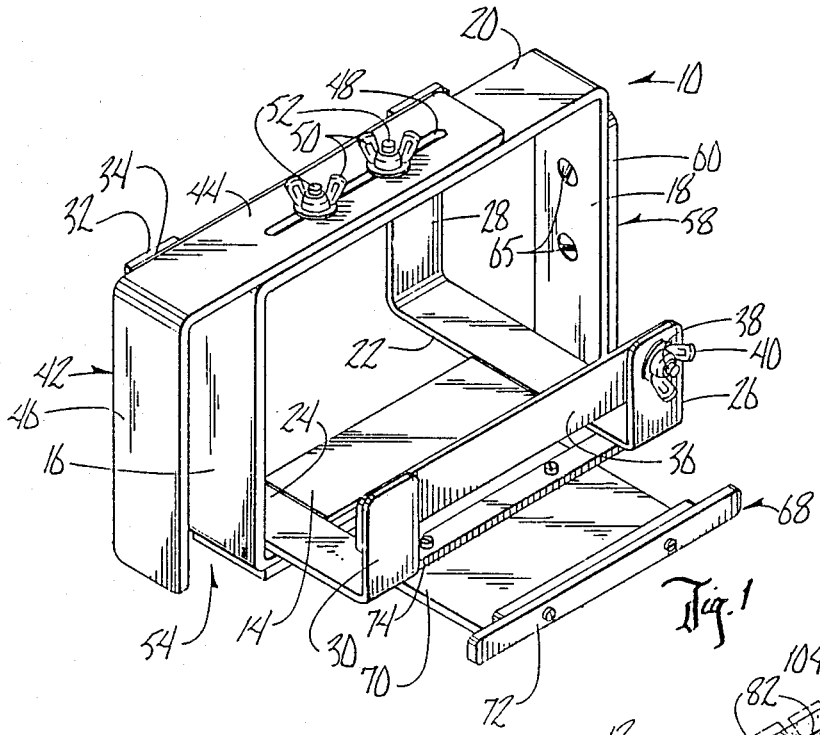
FIG. 1 is a perspective view of the holding frame of the present invention.
Figure 2:
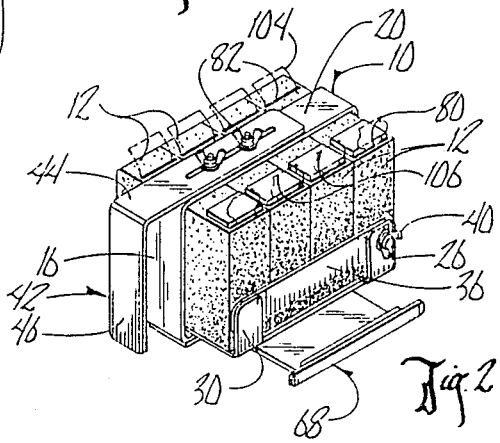
FIG. 2 is a perspective view similar to FIG. 1 showing the holding frame with four label dispensing boxes therein.
Figure 3:
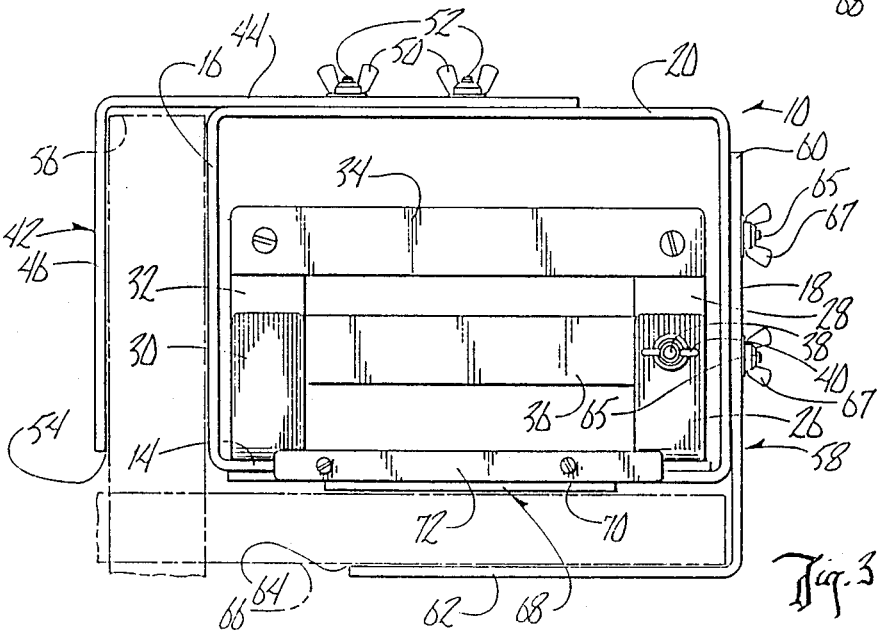
FIG. 3 is a front elevational view of the holding frame of the present invention.
Figure 4:
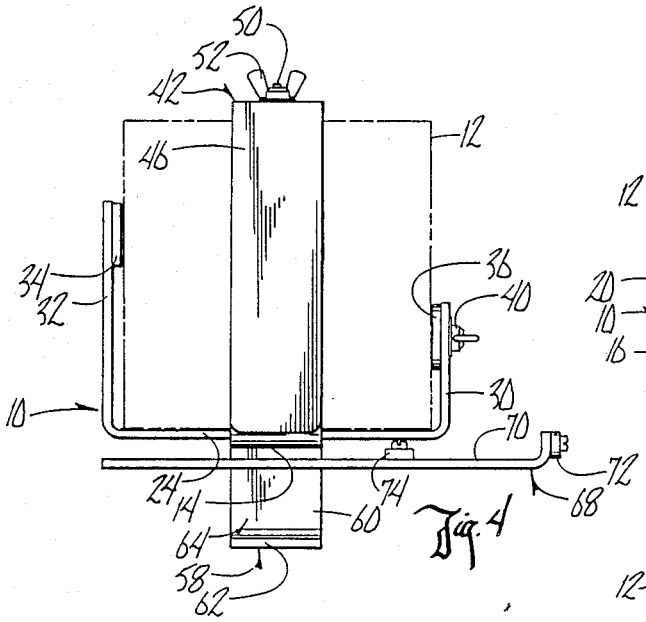
FIG. 4 is an end elevational view as viewed from the left of FIG. 3.

Referring to the drawings, the numeral 10 refers to the holding frame of the present invention. Frame 10 is used to hold a plurality of label dispenser boxes 12 (FIG. 2). Frame 10 includes a bottom frame member 14, a pair of side frame members 16, 18, and a top frame member 20. Attached to bottom frame member 14 are a pair of transverse web members 22, 24. At the forward end of web member 22 is an upstanding end portion 26 and at the other end of web frame member 22 is a rear upstanding leg portion 28. Similarly, web member 24 is provided with a front upstanding member 30 and a rear upstanding member 32. The upper ends of rear upstanding members 28, 32 are attached to the opposite ends of a back frame member 34 (FIG. 3). The front upstanding portions 26, 30 are interconnected by front frame member 36. Front frame member 36 is attached to upstanding member 26 by means of a bolt 38 and wing nut 40. By loosening wing nut 40 it is possible to pivot front frame member 36 upwardly out of blocking engagement with the dispenser boxes 12 so as to permit the dispenser boxes to be removed from the holding frame 10.

The dispenser boxes 12 are held in side-by-side relation within the holding frame 10, with the bottom frame member 14 supporting the boxes, and with the side frame members 16, 18, the top frame member 20, the front member 36, and the rear member 34 confining the boxes and holding them against movement within the holding frame.

Detachably mounted to top frame member 20 is an L-shaped bracket 42 having a first leg 44 and a second leg 46. Within first leg 44 is an elongated slot 48 which receives two bolts 52, each of which includes a wing nut 50 thereon for detachably securing the L-shaped bracket 42 to the upper frame member 20. The slot 48 permits the bracket to be adjusted longitudinally with respect to top frame member 20, thereby adjusting the distance between the second leg 46 of L-shaped bracket 42 and the side frame member 16. This provides a space 54 which can receive an upstanding wall such as wall 56 shown in FIG. 3 for supporting the holding frame 10. L-shaped bracket 42 can also be removed and reversed so as to provide a space on the right-hand side of frame 10, the space being formed between side frame member 18 and second leg 46.

A second L-shaped member 58 includes a first leg 60 and a second leg 62. First leg 60 is attached to side frame member 18 by means of bolts 65 which extend through an elongated slot 63 similar to slot 48 in the first L-shaped bracket 42. Bolts 65 extend through slot 48 and receive wing nuts 67 which permit longitudinal adjustment of L-shaped bracket 58 with respect to side frame 18 so as to permit the second leg 62 of L-shaped bracket 58 to be moved toward and away from bottom frame member 14. This provides a space 64 for accommodating a table top or shelf 66.

Figure 6:
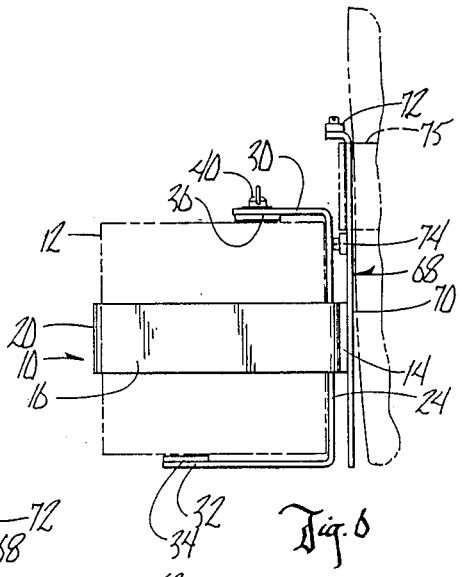
FIG. 6 is an end elevational view of the device showing the device mounted on a person's belt.
Figure 5:
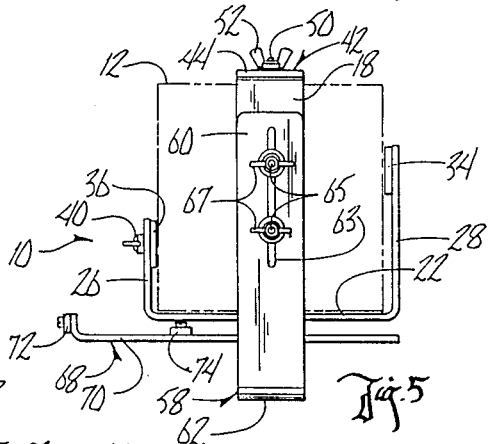
FIG. 5 is an end elevational view as viewed from the right of FIG. 3.

A belt bracket 68 is attached to the bottom surface of bottom frame member 14 and extends forwardly therefrom. Belt bracket 68 includes a horizontally extending plate 70 having an upstanding cross member 72 at its forward end and a cross member 74 spaced inwardly from cross member 72. Belt bracket 68 is used in the manner shown in FIG. 6. Belt bracket 68 is inserted beneath a wearer's belt 75 in the manner shown in FIG. 6 with cross member 72 being positioned above the wearer's belt and with cross member 74 being positioned below the wearer's belt. Plate 70 extends beneath the wearer's belt. This holds the dispenser on the wearer's belt in the manner shown in FIG. 6 and permits the wearer to move about while still keeping the dispensers in a convenient position for removal of the labels.

The various portions of holding frame 10 are shown attached to one another by bolts, welding or other means. However, it is possible for all of the various members of holding frame 10 to be molded into a single unit with the exception of the two L-shaped members 42, 58, which must necessarily be movable with respect to the remainder of the frame.

Figure 7:
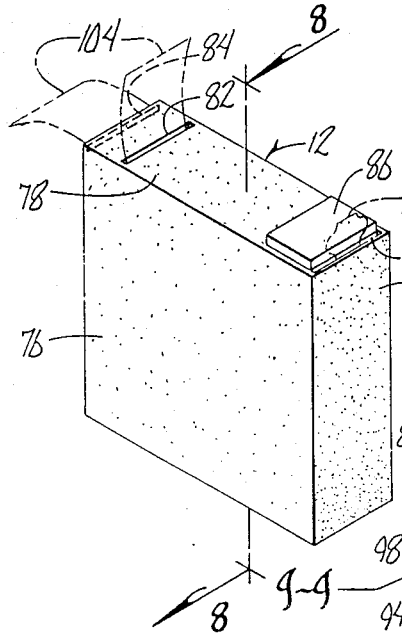
FIG. 7 is a perspective view of the dispenser box of the present invention.
Figure 9:
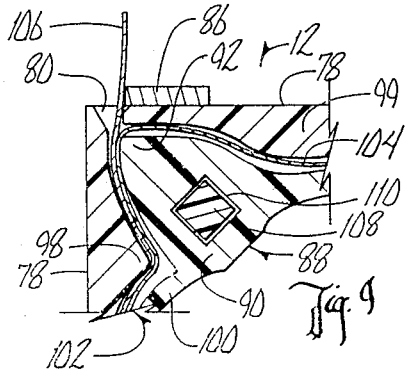
FIG. 9 is an enlarged sectional view taken along line 9—9 of FIG. 8.
Figure 8:
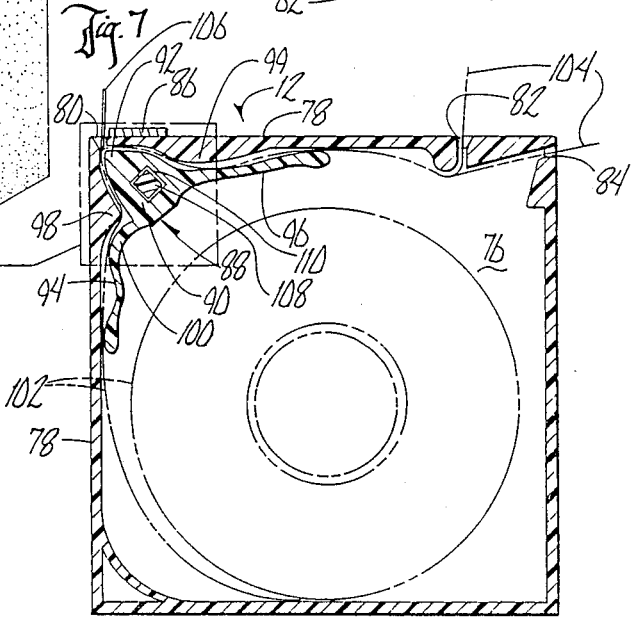
FIG. 8 is a sectional view taken along line 8—8 of FIG. 7.
Figure 10:
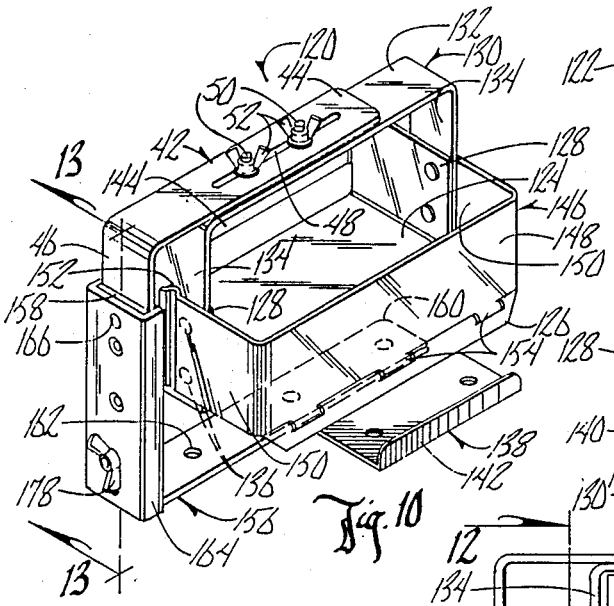
FIG. 10 is a perspective view of a modified form of the invention.
Figure 12:
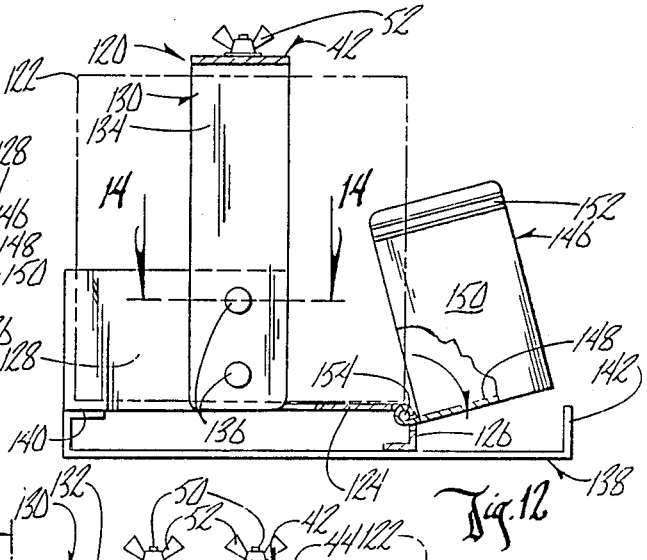
FIG. 12 is a sectional view taken along line 12—12 of FIG. 11.

Referring to FIGS. 7–9 of the drawings, an improved form of dispenser box 12 is shown. Dispenser box 12 includes a pair of opposite rectangular side walls 76, and a continuous edge wall 78 which encloses the box 12. The top portion of edge wall 78 includes a label slot 80, and two backing strip slots 82, 84. Positioned adjacent label slot 80 on the exterior thereof, is a rectangular block 86.

Within box 12 adjacent label slot 80, is a guide member 88. Guide member 88 includes a central portion 90 having a nose 92 positioned adjacent in close spaced relation to slot 80. Extending opposite directions from central portion 90 are a pair of leaf members 94, 96 which are positioned in close spaced relation to edge wall 78 of box 12, and which extend in opposite directions from slot 80. Edge wall 78 includes a pair of inwardly extending nodes 98, 99 which are positioned on opposite sides of slot 80. Leaf member 94 includes a complementary outwardly extending node 100 which is adjacent node 98.

Mounted within box 12 is a coiled label tape 102 which is shown in detail in FIG. 9. Label tape 102 comprises a continuous backing strip 104 having a continuous set of segmented labels 106 detachably adhered to backing strip 104. The label tape 102 is threaded in the space between leaf portion 94 of guide member 88 and the edge wall 78 of box 12. The tape threads through the adjacent nodes 100, 98 and at slot 80, the label strip 106 is separated from the backing strip 104 and exits through slot 80. The backing strip continues on within the box 12 and is threaded in the space between leaf portion 96 and node 99 of edge wall 78. The backing strip 104 is then exited from box 12 through either slot 82 or slot 84. The operator, by pulling on backing strip 104 can cause the labels 106 to be fed outwardly through slot 80.

The nose 92 of central portion 90 provides an important function in that it causes the label strip to be separated from the backing strip adjacent slot 80. The entire guide member is held rigidly in place by a post 108 which is attached to side wall 76 of box 12 and which extends through a rectangular opening 110 in guide member 88. The square post 108 prevents rotation of or other movement of the guide member 88, and holds the guide member 88 in close spaced relation to the edge wall 78 as can be seen in FIG. 8.

Referring to FIGS. 10–17, a modified form 120 of the holding frame and a modified form 122 of the dispenser box are shown.

Holding frame 120 comprises a bottom plate 124 having a downwardly extending J-shaped flange 126 at the forward edge thereof. Bottom plate 124 also has two oppositely positioned and upwardly extending side plates 128. Secure to side plates 128 and extending upwardly therefrom is a U-shaped frame member 130 having a horizontal top bar 132 and two downwardly extending side bars 134 which are secured to the upstanding side plates 128. Adjacent the lower edges of side bars 134 are a pair of retention nodes 136.

A belt bracket 138 is secured to the lower surface of bottom plate 124 and includes a J-shaped flange 140 which is upwardly attached to the rear edge of bottom plate 124. J-shaped flange 126 of bottom plate 124 is operatively secured to belt bracket 138. Belt bracket 138 protrudes forwardly and includes an upwardly extending belt retaining lip 142 at its forward edge.

A rear bar 144 is attached to and extends between side plates 128 so as to retain the dispenser boxes 122 within the holding frame.

A U-shaped front wall 146 having a front plate 148 and two rearwardly extending side plates 150 with dimples 152 therein is mounted to the front edge of bottom plate 124 by means of a hinge 154. Front wall 146 can pivot about the axis provided by hinge 154 from an open position shown in FIG. 12 to the closed position shown in FIGS. 10 and 11. This permits the insertion and removal of the dispenser boxes 122. Dimples 152 retentively engage nodes 136 when the front wall 146 is in its closed position so as to hold the front wall 146 in its closed position.

Secured to the top bar 132 is a first L-shaped bracket 42 which is identical to the L-shaped bracket 42 shown in FIGS. 1–9. Accordingly, corresponding numerals are used. Bracket 42 is secured to top bar 132 by means of wing nuts 50 and bolts 52 in similar fashion to that shown in FIG. 1.

A second L-shaped bracket 156 includes a first leg 158 and a second leg 160 which are integral with one another and which extend 90 degrees with respect to one another. Second leg 160 is provided with a plurality of bolt holes 162 which permit attachment to various mounting surfaces.

An outer plate 164 having a U-shaped cross-sectional configuration is mounted to first leg 158 by means of an upper rivet 166. A movable plate 168 is secured to first leg 158 at its lower end by means of a lower rivet 174. A spacer plate 172 causes the formation of an elongated slot 170 between movable plate 168 and first leg 158. A bolt 176 extends through the lower end of movable plate 168 and also through first leg 158 and outer plate 164. A wing nut 178 is threaded over the end of bolt 176.

Figure 11:
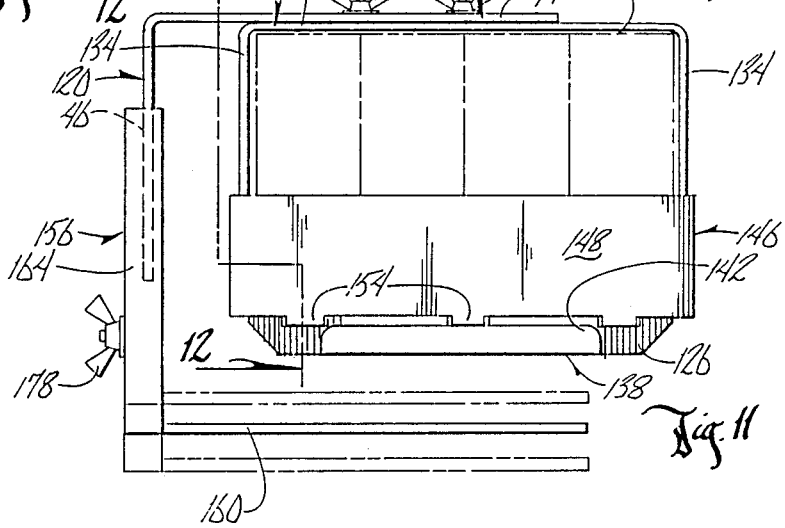
FIG. 11 is a front elevational view thereof.
Figure 13:
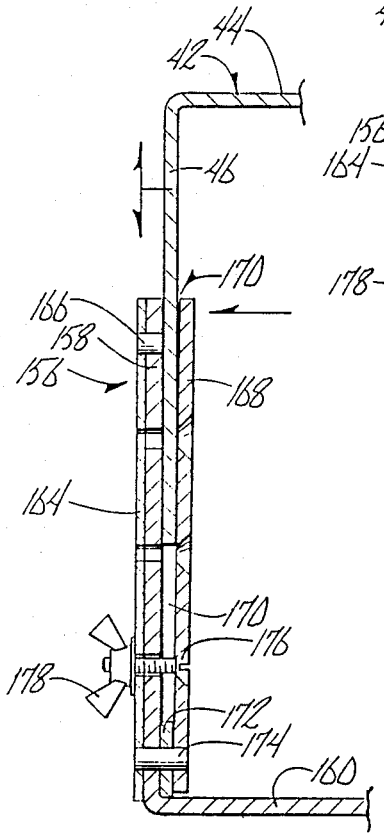
FIG. 13 is a sectional view taken along line 13—13 of FIG. 10.
Figure 14:
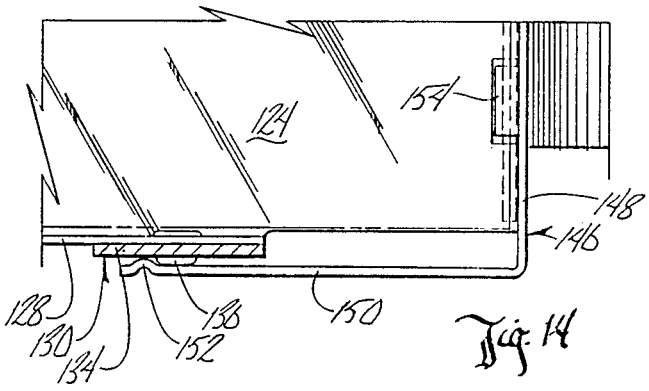
FIG. 14 is an enlarged sectional view taken along line 14—14 of FIG. 12.
Figure 19:
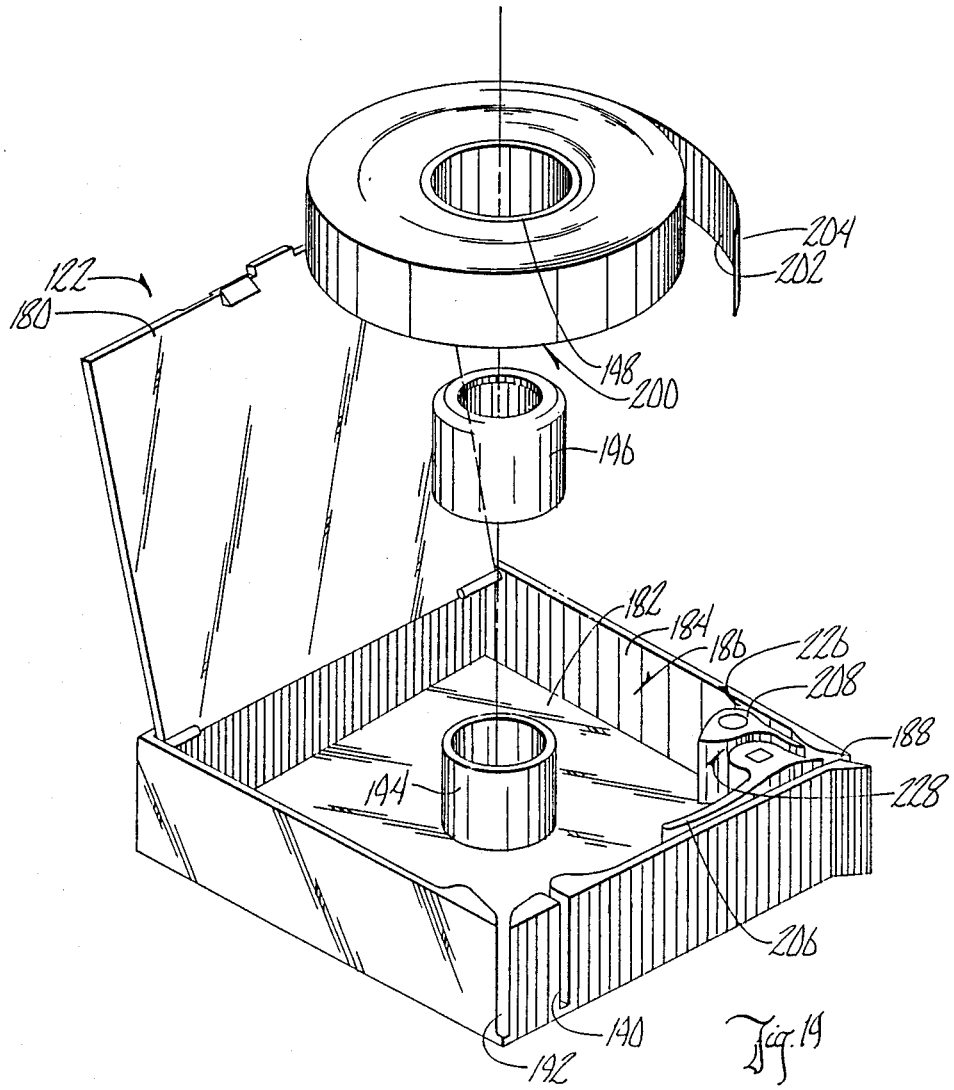
FIG. 19 is an exploded perspective of the dispenser shown in FIGS. 16–18.

As can be seen in FIG. 13, the leg 46 of first L-shaped bracket 42 fits telescopically within the slot 170. The wing nut 178 can then be tightened to cause the movable plate 168 to move towards the first leg 158 of second L-shaped bracket 156. This creates a pinching action which retentively holds leg 146 in slot 170. As can be seen in FIG. 11, the second L-shaped bracket 156 can be adjusted upwardly and downwardly with respect to the first L-shaped bracket 42 merely by loosening and retightening the wing nut 178.

FIG. 15 illustrates the flexibility of the present invention. The first and second U-shaped brackets 42, 156 can be arranged in various shapes and configurations. In FIG. 15, the device is shown mounted to a vertical wall which is to be contrasted from the configurations shown in FIGS. 10–11, wherein the device is adapted to be mounted on a horizontal surface such as a table.

Referring to FIGS. 16–19, dispenser box 122 comprises first and second side walls 180, 182 which are parallel and spaced apart from one another. A perimetric edge wall 184 extends around the perimeters of first and second side walls 180 182 and in combination with edge walls 180, 182 provides an enclosed compartment 186. Edge wall 184 includes a label slot 188 and first and second spaced apart backing strip slots 190, 192 all of which extend perpendicularly to the side walls 180, 182.

Within compartment 186 is a cylindrical pivot post 194 which is attached to side wall 182 and which is located at the approximate geometric center of side wall 182. Telescopically fitted over pivot post 194 is a cylindrical sleeve 196 which is adapted to frictionally fit within a cylindrical core 198 of a coil 200 of label tape. The coil of label tape is comprised of a backing strip 202 (FIG. 17) and a label strip 204 which is detachably adhered to one surface of the backing strip 202.

Also within compartment 186 are a first guide member 206 and a second guide member 208. Guide member 206 comprises a pointed nose 210 which is located closely adjacent label slot 188. It should be noted that nose 210 is spaced from but closely adjacent the edge wall 184 in the vicinity of the label slot 188. First guide member 206 also includes a wing flange 212 which extends along a portion of the edge wall 184 in close spaced relationship thereto. First guide member 206 also includes a rounded surface 214 and a hole 216 which is square in cross-section and which extends through guide member 206 in a direction perpendicular side walls 180, 182. Extending within square hole 216 is a square peg 218 which is fixed to side wall 182. This mating relationship of peg 218 within hole 216 holds the guide member 206 in rigid orientation with respect to slot 188. However, it permits the quick and easy removal of guide member 206 merely by lifting guide member 206 upwardly off of peg 218. This permits the clearing of the tape or strips in the event they become entangled.

Second guide member 208 includes a wing flange 220 which extends along edge wall 184 on the opposite side of slot 188 from the wing flange 212 of guide member 206. Second guide member 208 includes a rounded surface 222 and a concave surface 224. Rounded surface 222 and wing flange 220 provide a first guide path 226 which is formed between edge wall 184 and second guide member 208. The concave surface 224 of guide member 208 conforms generally to the curved surface 214 of guide member 206, and a second guide pathway 228 is formed in the space therebetween. Guide member 208 includes a round hole 230 extending therethrough and receiving a round peg 232 which is fixed to side wall 182. This permits second guide member 208 to pivot slightly so as to prevent binding of the label tape when it is passing through either passageway 226 or passageway 228. Also, the second guide member 208 can be removed merely by lifting it upwardly off of peg 232.

The coil label tape 200 can be formed in two different ways. In FIG. 17 the coil is shown with the label strip being adhered to the outwardly presented surface of the backing strip. In this configuration, the label tape is threaded through first passageway 226. At the label slot 188, the label strip is separated from the backing strip and exists through slot 188. The backing strip 202 continues downwardly between the wing flange 212 and the edge wall 184 and exits either through slot 190 or 192. Either of these two slots may be used depending upon the particular orientation of the box 122. Manual pulling of the backing strip will cause the label strip to emerge from slot 188, and the labels can be used one at a time.

FIG. 18 illustrates how the device 122 can be used with a coil label tape 200, wherein the labels are detachably adhered to the inwardly facing surface of backing strip 202. In this configuration, the label tape 200 is threaded through second passageway 228. At the label slot 188, the labels exit through slot 188, and the backing strip 202 extends downwardly in the same fashion as described in FIG. 17.

The sleeve 196 and the post 194 provide a bearing assembly which centers the coil 200 within the box 122 and which permits it to rotate easily without binding.

A plurality of rectangular label dispensers 12 can be placed within the holding frame 10 as shown in FIG. 2. The L-shaped mounting brackets 42, 58, and the belt mounting bracket 68 provide a universal ability to mount the holding bracket anywhere desired. For example, L-shaped bracket 58 can be attached to a horizontal supporting surface and the holding frame then connected to this L-shaped bracket as shown in FIG. 3. It is also possible to remove the holding frame from this L-shaped bracket and reverse its position to the opposite side of vertical member 60, thereby causing the frame to extend to the right of vertical chamber 60, rather than to the left as shown in FIG. 3. Similarly, the L-shaped bracket 42 can be reversed to permit left or right-hand mounting of the holding frame relative to a vertical support wall 56. The belt bracket 68 permits the device to be mounted on a wearer's belt, so as to make the device portable, yet convenient for use.

The dispenser of the present invention provides an improved means for dispensing the various labels to be used. At least one of the side walls 76 of dispenser box 12 is hinged so as to be openable to permit the insertion or removal of the label tape 102.

Thus, it can be seen that the device accomplishes at least all of its stated objectives.

I claim:

1. In combination:

a rectangular holding frame having a bottom support member, a top member, a pair of spaced apart end members, a back member, and a front member;

at least two rectangular label dispensers positioned in side-by-side relationship and resting on said bottom member, said label dispensers being positioned between said spaced apart end members, and also being positioned between said front and back members whereby said label dispensers are retentively held against movement within said holding frame and against removal from said holding frame;

at least one of said bottom support member, said end members, said front member and said back member being selectively movable with respect to said holding frame from a first position blocking said label dispensers from removal from said holding frame to a second position permitting removal of said label dispensers from said holding frame;

universal bracket means attached to said holding frame for permitting attachment of said holding frame to a plurality of types of support structures in a variety of positions and orientations;

said bracket means comprising an L-shaped first bracket having a first leg and a second leg extending perpendicular to one another, said first leg of said first bracket having an elongated slot therein;

first bolt means extending through said slot of said first bracket;

said holding frame having a plurality of bolt receiving holes located in a plurality of locations on said holding frame for receiving said first bolt means to permit detachable and adjustable securement of said first bracket to said holding frame in a plurality of positions relative to said holding frame.

2. A combination according to claim 1 wherein said bracket means further comprises an L-shaped second bracket having a first leg and a second leg extending perpendicular to one another, said first leg of said second bracket including securing means for securing said first leg of said second bracket to one of said first and second legs of said first bracket.

3. A combination according to claim 2 wherein said securing means comprises an elongated securing slot sized to telescopically receive said one of said first and second legs of said first bracket.

4. A combination according to claim 3 wherein said securing means includes a fixed member and a movable member forming opposite walls of said securing slot, said movable member being movable toward said fixed member to a retaining position for retentively retaining said one of said first and second legs of said first bracket within said securing slot.

5. A combination according to claim 4 wherein said fixed and movable members are elongated and have first and second opposite ends, said first ends of said fixed and movable members being attached to one another and said second ends of said fixed and movable ends being spaced apart and free from attachment to one another.

6. A combination according to claim 5 wherein a locking bolt means extends through said fixed and said movable members for moving said fixed and movable members to said retaining position.

7. In combination:

a dispenser box having a pair of opposite parallel and spaced apart side walls and a continuous edge wall extending around the perimeters of said side walls so as to form an enclosed compartment within said box;

said compartment having an interior center;

said edge wall having first and second spaced apart elongated slots therein extending perpendicularly to said opposite side walls;

an elongated label tape within said compartment and being wound into a tape coil having a protruding end, said label tape comprising a backing strip and a label strip detachably adhered to said backing strip;

guide means secured within said compartment of said box, said guide means having a nose positioned adjacent and in close spaced relation to said edge wall adjacent said first slot;

said guide means being shaped to provide first and second tape paths within said compartment extending from said tape coil to said nose of said guide means;

said protruding end of said label tape extending through one of said first and second tape paths formed by said guide means, said label strip being separated from said backing strip within said compartment adjacent said first slot and extending through said first slot to the exterior of said box, said backing strip continuing within said compartment and passing through said second slot to the exterior of said box.

8. A combination according to claim 7 wherein said backing strip comprises an inwardly presented surface and an outwardly presented surface within said coil, said label strip being detachably adhered to said outwardly presented surface of said backing strip, said first tape path of said guide means extending between said edge wall and a portion of said nose of said guide means.

9. A combination according to claim 8 wherein said guide means comprises a first guide member forming at least a portion of said first tape path, said first guide member being movably mounted to said box for pivotal movement about a first guide axis perpendicular to said side walls.

10. A combination according to claim 7 wherein said guide means comprises first and second guide members, said first tape path extending between said first guide member and said edge wall, said second tape path extending between said first and second guide members.

11. A combination according to claim 7 wherein said guide means is detachably mounted within said compartment.

12. A combination according to claim 11 wherein said guide means comprises first and second guide members, said first guide member being pivotally mounted to said box for pivotal movement about a first guide member axis perpendicular to said side walls, said second guide member being detachably secured to said box in such a manner to be held against rotational movement.

13. A combination according to claim 7 wherein a bearing assembly is located adjacent said interior center of said compartment, said bearing comprising a cylindrical post attached to one of said side walls and extending perpendicularly therefrom, and a cylindrical sleeve telescoped over said post and adapted to rotate thereon, said coil of said label tape having a core upon which said coil is formed, said core having a circular opening therein, said sleeve protruding within said circular opening of said core for permitting said coil, said core, and said sleeve to rotate about said post.

14. A combination according to claim 13 wherein said sleeve has a diameter approximately the same size as the diameter of said circular opening of said core, whereby said core and said coil are retained in centered relationship to said interior center of said compartment.

* * * * *